US009130253B2

(12) United States Patent
Mita et al.

(10) Patent No.: US 9,130,253 B2
(45) Date of Patent: Sep. 8, 2015

(54) WAVEGUIDE FOR IN-VEHICLE COMMUNICATION SYSTEM

(71) Applicant: YAZAKI CORPORATION, Minato-ku, Tokyo (JP)

(72) Inventors: Akira Mita, Susono (JP); Masaaki Okada, Susono (JP); Takuo Matsumoto, Susono (JP); Takashi Gohara, Susono (JP)

(73) Assignee: YAZAKI CORPORATION, Tokyo (JP)

( * ) Notice: Subject to any disclaimer, the term of this patent is extended or adjusted under 35 U.S.C. 154(b) by 86 days.

(21) Appl. No.: 13/896,392

(22) Filed: May 17, 2013

(65) Prior Publication Data

US 2013/0307645 A1 Nov. 21, 2013

(30) Foreign Application Priority Data

May 21, 2012 (JP) ..... 2012-115443

(51) Int. Cl.
*H01P 3/12* (2006.01)
*H01P 3/127* (2006.01)

(52) U.S. Cl.
CPC . *H01P 3/12* (2013.01); *H01P 3/127* (2013.01)

(58) Field of Classification Search
CPC ..... H01P 3/12; H01P 3/127; H01P 3/13
USPC ..... 333/239, 241, 242, 248, 237, 240, 22 R
See application file for complete search history.

(56) References Cited

U.S. PATENT DOCUMENTS

| | | | | | |
|---|---|---|---|---|---|
| 3,559,111 | A | * | 1/1971 | Suetake et al. | 333/22 R |
| 4,605,914 | A | * | 8/1986 | Harman | 333/237 |
| 4,780,695 | A | * | 10/1988 | Watari et al. | 333/237 |
| 5,230,085 | A | * | 7/1993 | Loposer | 455/41.2 |
| 5,247,270 | A | * | 9/1993 | Harman et al. | 333/237 |
| 5,363,464 | A | | 11/1994 | Way et al. | |
| 5,960,144 | A | | 9/1999 | Klumps et al. | |
| 2003/0122636 | A1 | * | 7/2003 | DiBenedetto | 333/237 |

FOREIGN PATENT DOCUMENTS

| | | | |
|---|---|---|---|
| CN | 101324686 | A | 12/2008 |
| CN | 101499334 | A | 8/2009 |
| CN | 201319081 | Y | 9/2009 |
| DE | 1013737 | B | 8/1957 |

(Continued)

OTHER PUBLICATIONS

German office action letter issued on Sep. 22, 2014.

(Continued)

*Primary Examiner* — Benny Lee
(74) *Attorney, Agent, or Firm* — Marvin A. Motsenbocker; Mots Law, PLLC

(57) ABSTRACT

A waveguide includes a waveguide body which is hollow inside and made from a shape-retentive material, and a conductive inner coating layer which is electrically conductive and provided on an inner surface of the waveguide body. The waveguide uses an inner space of the conductive inner coating layer as a transmission path to transmit electromagnetic waves as signals. Two electric wires provided along the outer surface of the waveguide body serve respectively as a power line and a ground line to transmit electric power.

7 Claims, 7 Drawing Sheets

(56) References Cited

FOREIGN PATENT DOCUMENTS

| | | | |
|---|---|---|---|
| DE | 1099022 | A | 2/1961 |
| DE | 1590675 | B | 5/1970 |
| DE | 602004009271 | T2 | 2/2008 |
| EP | 0005029 | A1 | 10/1979 |
| JP | 2002-204110 | A | 7/2002 |
| JP | 2005-176123 | A | 6/2005 |

OTHER PUBLICATIONS

Chinse office action letter issued on Dec. 3, 2014 in the counterpart Chinese patent application.

* cited by examiner

WAVEGUIDE FOR IN-VEHICLE COMMUNICATION SYSTEM

BACKGROUND OF THE INVENTION

1. Field of the Invention

The present invention relates to a waveguide for transmitting electromagnetic waves, and an in-vehicle communication system using the waveguide.

2. Description of the Related Art

An in-vehicle communication system employing a wire harness using electric wires is well-known. FIG. 1 illustrates such a conventional in-vehicle communication system. A conventional in-vehicle communication system 100 in FIG. 1 includes a first wire harness 101 installed in an interior space, and a second wire harness 102 installed in an engine compartment. The first wire harness 101 includes a plurality of electric wires W, and a plurality of connectors 111 connected to both sides of each electric wire W. The second wire harness 102 includes a plurality of electric wires W, and a plurality of connectors 112 connected to both sides of each electric wire W. The electric wires W are tied together into a small diameter with, for example, binding tape. The connectors 111 of the first wire harness 101 are connected to the corresponding connectors 112 of the second wire harness 102 at the boundary between the interior space and the engine compartment. These connections provide transmission paths across the boundary between the respective spaces inside the vehicle.

In the in-vehicle communication system 100, the number of the electric wires W tends to increase with the increase of in-vehicle circuits, and the diameter of each bundle of the electric wires W increases accordingly. Thus, there is a problem with installation space inside the vehicle, or a problem with weight increase of the first wire harness 101 and the second wire harness 102. In addition, the number of the connectors connected between the interior space and the engine compartment increases, which requires substantial work to connect the connectors.

An in-vehicle communication system employing a waveguide has also been proposed (refer to JP 2005-176123 A). Such a conventional in-vehicle communication system can reduce a diameter and weight of transmission path, and simplify connection configuration between spaces inside a vehicle, thereby improving efficiency of connection.

The conventional waveguide is generally made of metal. Alternatively, a waveguide made of electrically-conductive plastic has been proposed (refer to JP 2002-204110 A).

SUMMARY OF THE INVENTION

However, there is no specific information about electric power transmission in the proposed waveguides. In the case of using such a waveguide in an in-vehicle communication system, electric power transmission is essential and therefore, a proposal for specific means for the electric power transmission is required.

The present invention has been made in view of the above-described problem. It is an object of the present invention to provide a waveguide capable of transmitting electric power, and an in-vehicle communication system using the waveguide.

A waveguide according to a first aspect of the present invention includes a waveguide body which is hollow inside and made from a shape-retentive material; one or two conductive coating layers which are electrically conductive and provided on one or both of an inner surface and an outer surface of the waveguide body, an inner space of one of the conductive coating layers serving as a transmission path to transmit electromagnetic waves including signals; and a power line for transmitting electric power.

The waveguide body is preferably made from a flexible material.

Two or more electric wires may be provided along the outer surface of the waveguide body. With such a configuration, one of the electric wires can serve as the power line and the other one of the electric wires can serve as a ground line to transmit the electric power.

One or more electric wires may be provided along the outer surface of the waveguide body. With such a configuration, one of the electric wires can serve as the power line and one of the conductive coating layers can serve as a ground line to transmit the electric power.

Two of the conductive coating layers may be provided. With such a configuration, one of the conductive coating layers can serve as the power line and the other of the conductive coating layers can serve as a ground line to transmit the electric power.

The electromagnetic waves may transmit the signals and the electric power.

Two or more electric wires may be provided inside of the waveguide body. With such a configuration, one of the electric wires can serve as the power line and the other one of the electric wires can serve a ground line to transmit the electric power.

The waveguide may include a cap attached to an opening edge of the waveguide body and provided, inside thereof, with an electromagnetic wave absorbing material capable of absorbing the electromagnetic waves.

One conductive coating layer may be provided on the inner surface of the waveguide body, the waveguide body may be made from a protective material, and the waveguide body may also function as an outer protective member.

The waveguide according to the first aspect of the present invention may be used for an in-vehicle communication system.

The waveguide according to the first aspect of the present invention can transmit both of the electric power and the electromagnetic waves including the signals. Accordingly, the waveguide capable of transmitting the electric power and the in-vehicle communication system using the waveguide, can be provided.

DETAILED DESCRIPTION OF THE PREFERRED EMBODIMENTS

Embodiments of the present invention will be explained below with reference to the drawings.

(First Embodiment)

Figure 1:
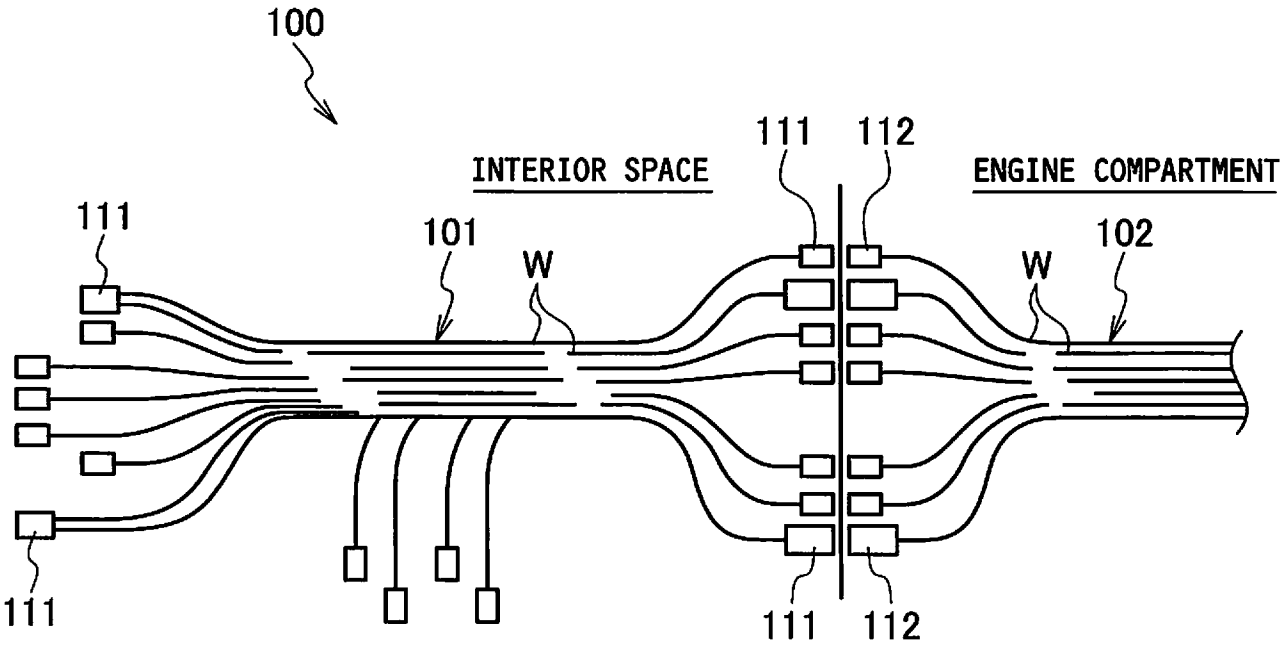
FIG. 1 PRIOR ART
FIG. 1 is a schematic configuration diagram of a conventional in-vehicle communication system employing wire harnesses using electric wires.
Figure 2:
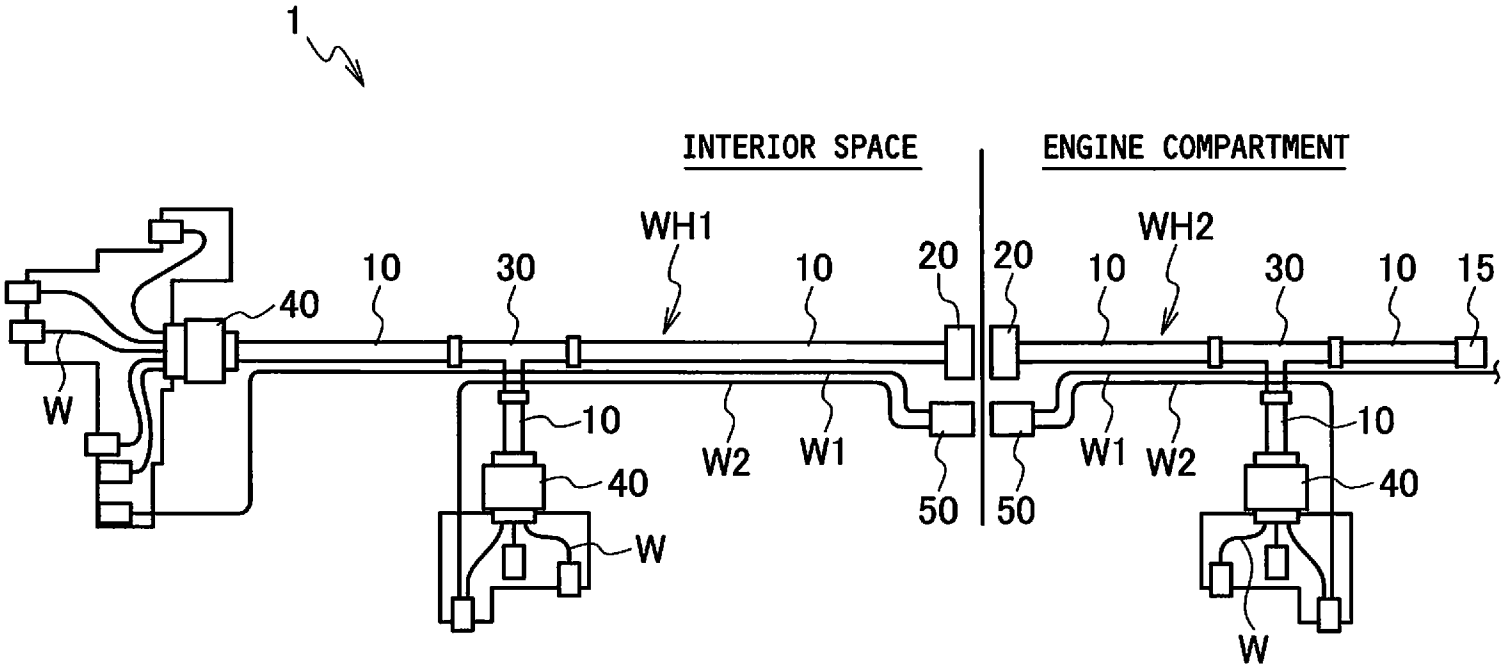
FIG. 2 is a schematic configuration diagram of an in-vehicle communication system using a waveguide according to a first embodiment.
Figure 3A:
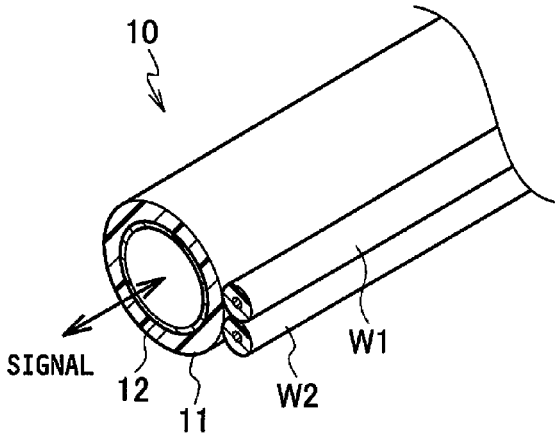
FIG. 3A is a fracture perspective view of the waveguide according to the first embodiment.
Figure 3B:
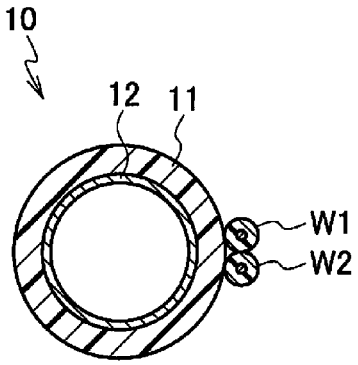
FIG. 3B is a cross-sectional view of the waveguide according to the first embodiment.
Figure 3C:
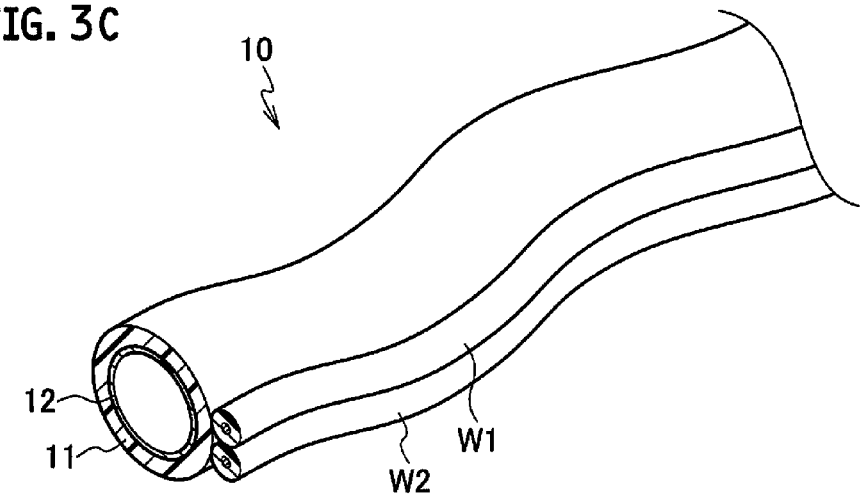
FIG. 3C is a broken perspective view of the waveguide, in a bent state, according to the first embodiment.
Figure 4:
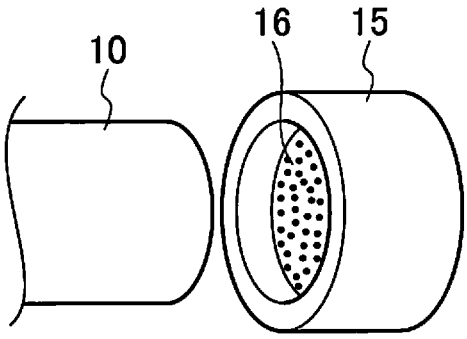
FIG. 4 is a perspective view of a cap attached to an opening end of the waveguide according to the first embodiment.

FIGS. 2 to 4 illustrate a first embodiment of the present invention.

As illustrated in FIG. 2, an in-vehicle communication system 1 according to the first embodiment is installed across the boundary between an interior space and an engine compartment, and includes a first waveguide wire harness WH1 installed in the interior space and a second waveguide wire harness WH2 installed in the engine compartment. Each of the first waveguide wire harness WH1 and the second waveguide wire harness WH2 includes waveguides 10, a waveguide flange 20, a branch 30 provided at a branched portion of the waveguides 10, and an intelligent connector 40 attached to one of the end portions of the waveguides 10.

The waveguides 10 of the first waveguide wire harness WH1 and the waveguides 10 of the second waveguide wire harness WH2 are mutually connected via each waveguide flange 20 at the boundary between the interior space and the engine compartment.

Each of the first waveguide wire harness WH1 and the second waveguide wire harness WH2 includes two electric wires W1 and W2, and a connector 50 attached to the electric wires W1 and W2. The connector 50 of the first waveguide wire harness WH1 and the connector 50 of the second waveguide wire harness WH2 are connected to each other at the boundary between the interior space and the engine compartment.

The intelligent connector 40 has an antenna function to transmit and receive electromagnetic waves, a converting function to convert the electromagnetic waves received by the antenna into electric signals, and a transmitting function to convert the electric signals into the electromagnetic waves and output the converted electromagnetic waves to the antenna. That is, the intelligent connector 40 serves as a junction member of the waveguides 10 and the electric wires W so as to convert data between the electromagnetic waves and the electric signals.

As illustrated in FIGS. 3A, 3B and 3C, each of the waveguides 10 includes a waveguide body 11 which is hollow inside and made from a shape-retentive material, a conductive inner coating layer 12 which is electrically conductive and provided on the inner surface of the waveguide body 11, and the two electric wires W1 and W2 provided along the outer surface of the waveguide body 11. The internal space of the conductive inner coating layer 12 serves as a transmission path for the electromagnetic waves. The waveguides 10 transmit, as signals (FIG. 3A), the electromagnetic waves in extremely high frequency band such as microwave or millimeter wave.

The waveguide body 11 is made of insulating synthetic resin that provides a shape-retentive feature (for example, vinyl chloride) having a noise shielding property, and is flexibly formed. Alternatively, the waveguide body 11 may be a conductor or a semiconductor, or may be made of paper or metal that provides a shape-retentive feature. The waveguide body 11 is formed into a hollow cylindrical shape.

The conductive inner coating layer 12 is formed by, for example, plating with conductive metal (such as iron, copper, and aluminum). The conductive inner coating layer 12 is provided with a uniform thickness on an entire inner surface of the waveguide body 11.

One of the electric wires W1 and W2 serves as a power line, and the other serves as a ground line, and the electric wires W1 and W2 transmit electric power. The electric wires may be provided more than two.

As illustrated in FIGS. 2 and 4, a cap 15 is attached to an opening edge of the waveguide 10. An electromagnetic wave absorber 16 (FIG. 4) that absorbs electromagnetic waves is provided on the inside of the cap 15. The electromagnetic wave absorber 16 (FIG. 4) prevents diffused reflection of the electromagnetic waves, thereby achieving stable communication performance.

As described above, since the waveguides 10 can transmit both of the electric power and the signals, the embodiment can provide the waveguides 10 capable of electric power transmission and the in-vehicle communication system 1 (FIG. 2) using the waveguides 10.

As shown in FIG. 2, the respective waveguides 10 of the first waveguide wire harness WH1 and the second waveguide wire harness WH2 can conduct multiplex communication by use of the electromagnetic waves when the part between the waveguide flanges 20 of each of the waveguide wire harnesses WH1 and WH2 is connected at the boundary between the interior space and the engine compartment. This improves the efficiency of connection.

Since the waveguide body 11 is flexibly formed (as shown in FIG. 3C), and cabling along arbitrary installation paths is thus possible, high installation performance is achieved.

The electric wires W1 and W2 may be fixed along the outer surface of the waveguide body 11 (as shown in FIGS. 3A and 3B),. The provision of the electric wires W1 and W2 increases the bending rigidity of the waveguides 10. Namely, such a configuration is effective at the point of bending the waveguides 10 while keeping the cross-sectional shape (circular shape) of the transmission paths of the waveguides 10.

The waveguide 10 according to the first embodiment is provided with the conductive inner coating layer 12 on the inner surface of the waveguide body 11. Alternatively, a conductive outer coating layer (not shown) with electrically conductive property may be provided on the outer surface of the waveguide body 11, instead of the conductive inner coating layer 12.

(Modified Examples of Waveguide)

Modified examples of the waveguide 10 according to the first embodiment are explained below.

Figure 5:
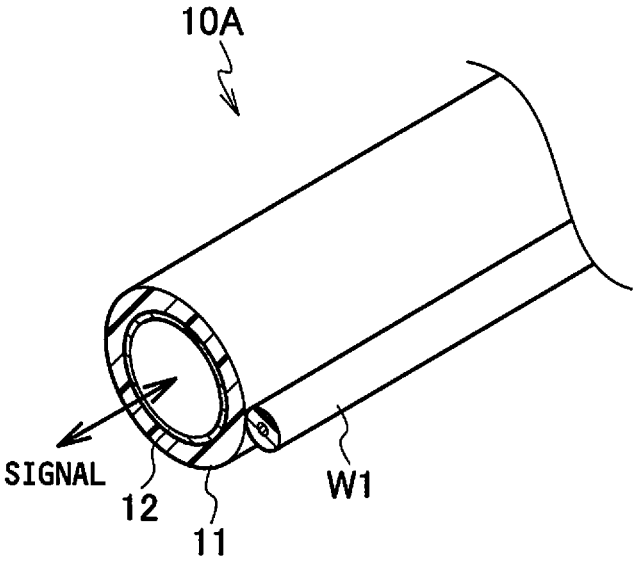
FIG. 5 is a broken perspective view of a waveguide according to a first modified example of the first embodiment.

As illustrated in FIG. 5, a waveguide 10A according to a first modified example of the first embodiment includes a waveguide body 11 which is hollow inside and made from a shape-retentive material, a conductive inner coating layer 12 which is electrically conductive and provided on the inner surface of the waveguide body 11, and a electric wire W1 provided along the outer surface of the waveguide body 11. The waveguide 10A transmits, as a signal (SIGNAL as shown in FIG. 5), electromagnetic waves in extremely high frequency band such as microwave or millimeter wave. The conductive inner coating layer 12 serves as a ground line, and the electric wire W1 serves as a power line. The conductive inner coating layer 12 and the electric wire W1 transmit electric power. The waveguide body 11 is made of insulating synthetic resin and flexibly formed into a cylindrical shape, as in the case of the first embodiment.

The electric wire W1 is preferably fixed to the outer surface of the waveguide body 11. The provision of the electric wire W1 increases the bending rigidity of the waveguide 10A. Namely, such a configuration is effective at the point of bending the waveguide 10A while keeping the cross-sectional shape (circular shape) of the transmission paths of the waveguides 10A.

The first modified example may also be provided with a conductive outer coating layer which is electrically conductive and provided on the outer surface of the waveguide body 11, instead of the conductive inner coating layer 12.

Figure 6:
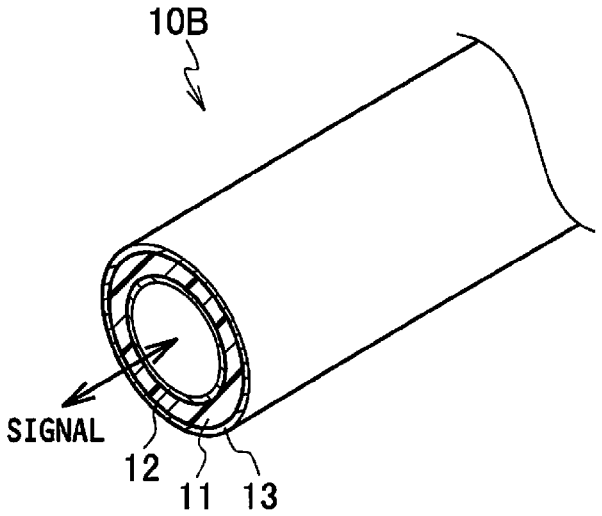
FIG. 6 is a broken perspective view of a waveguide according to a second modified example of the first embodiment.

As illustrated in FIG. 6, a waveguide 10B according to a second modified example of the first embodiment includes a waveguide body 11 which is hollow inside and made from a shape-retentive material, a conductive inner coating layer 12 which is electrically conductive and provided on the inner surface of the waveguide body 11, and a conductive outer coating layer 13 which is electrically conductive and provided on the outer surface of the waveguide body 11. The waveguide 10B transmits, as a signal (SIGNAL as shown in FIG. 6), electromagnetic waves in extremely high frequency band such as microwave or millimeter wave. The conductive inner coating layer 12 serves as a power line, and the conductive outer coating layer 13 serves as a ground line. The conductive inner coating layer 12 and the conductive outer coating layer 13 transmit electric power. The waveguide body 11 is made of insulating synthetic resin and flexibly formed into a cylindrical shape, as in the case of the first embodiment.

The waveguide 10B of the second modified example is different from the waveguide 10 of the first embodiment and the waveguide 10A of the first modified example in that no electric wire is provided thereon. This further contributes to reducing the diameter and weight of the transmission paths, and to simplifying the connection configuration between the spaces inside the vehicle, thereby improving the efficiency of connection.

An insulating protective coating may be further provided on the outer surface of the conductive outer coating layer 13. The insulating protective coating (not shown) may be made of vinyl chloride. The insulating protective coating protects the conductive outer coating layer 13.

Figure 7:
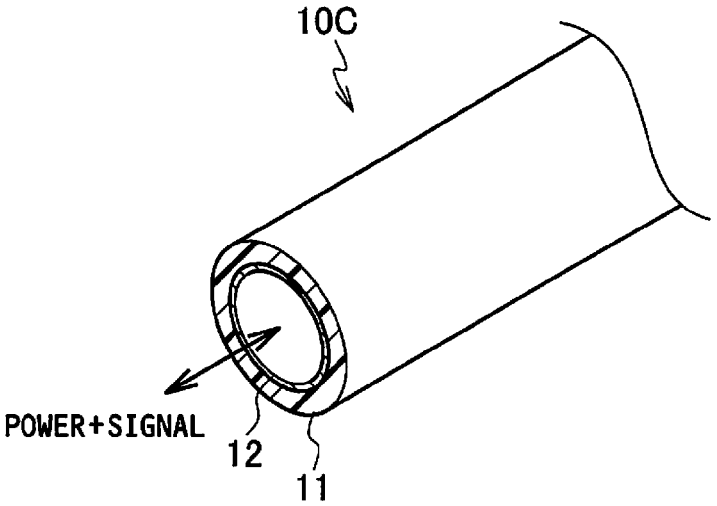
FIG. 7 is a broken perspective view of a waveguide according to a third modified example of the first embodiment.

As illustrated in FIG. 7, a waveguide 10C according to a third modified example of the first embodiment includes a waveguide body 11 which is hollow inside and made from a shape-retentive material, and a conductive inner coating layer 12 which is electrically conductive and provided on the inner surface of the waveguide body 11. There is no independent line to transmit electric power, but electromagnetic waves transmit both the electric power and signals. The waveguide body 11 is made of insulating synthetic resin and flexibly formed into a cylindrical shape, as in the case of the first embodiment.

The waveguide 10C of the third modified example is different from the waveguide 10 of the first embodiment and the waveguide 10A of the first modified example in that no electric wire is provided thereon. This contributes to reducing a diameter and weight of the transmission paths, and to simplifying the connection configuration between each compartment inside a vehicle, thereby improving the efficiency of connection.

The waveguide 10C according to the third modified example may also be provided with a conductive outer coating layer on the outer surface of the waveguide body 11, instead of the conductive inner coating layer 12.

Figure 8A:
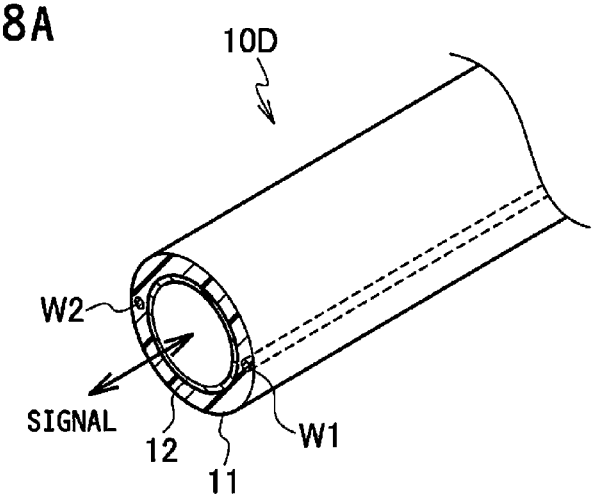
FIG. 8A is a broken perspective view of a waveguide according to a fourth modified example of the first embodiment.
Figure 8B:
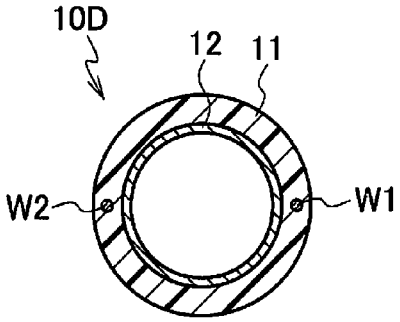
FIG. 8B is a cross-sectional view of the waveguide according to the fourth modified example.
Figure 8C:
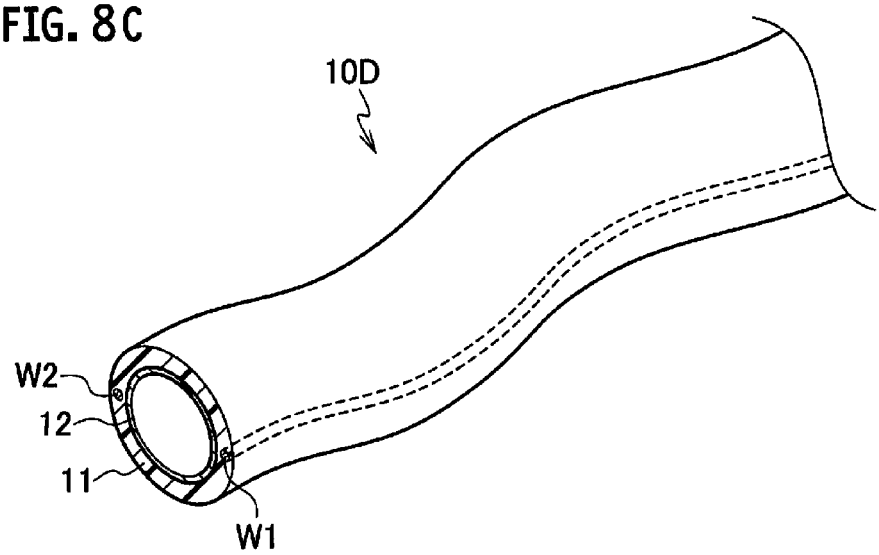
FIG. 8C is a broken perspective view of the waveguide, in a bent state, according to the fourth modified example.

As illustrated in FIGS. 8A to 8C, a waveguide 10D according to a fourth modified example of the first embodiment includes a waveguide body 11 which is hollow inside and made from a shape-retentive material, a conductive inner coating layer 12 which is electrically conductive and provided on the inner surface of the waveguide body 11, and two electric wires W1 and W2 provided inside of the waveguide body 11. The waveguide 10D transmits, as a signal (SIGNAL as shown in FIG. 8A), electromagnetic waves in extremely high frequency band such as microwave or millimeter wave. The waveguide body 11 is made of insulating synthetic resin and flexibly formed into a cylindrical shape in the same manner as the waveguide 10 of the first embodiment.

The electric wires W1 and W2 are preferably arranged at an angle of approximately 180 degrees to each other. Each of the electric wires W1 and W2 may be made of a stranded conductor, a single core conductor, or a compressed conductor. One of the electric wires W1 and W2 serves as a power line, and the other serves as a ground line. The electric wires W1 and W2 of the waveguide 10D according to the fourth modified example transmit electric power in the same manner as the waveguide 10 of the first embodiment. The electric wires provided may be more than two.

The electric wires W1 and W2 improve the bending rigidity of the waveguide 10D. Namely, the provision of the electric wires W1 and W2 is effective for the waveguide 10D at the point of bending while keeping the cross-sectional shape (circular shape) of the transmission paths of the waveguides 10D.

The arrangement of the electric wires W1 and W2 at the angle of approximately 180 degrees to each other can effectively prevent the waveguide body 11 from being pressed by external force.

The waveguide 10D according to the fourth modified example may also be provided with a conductive outer coating layer (not shown) on the outer surface of the waveguide body 11, instead of the conductive inner coating layer 12.

(Second Embodiment)

Figure 9:
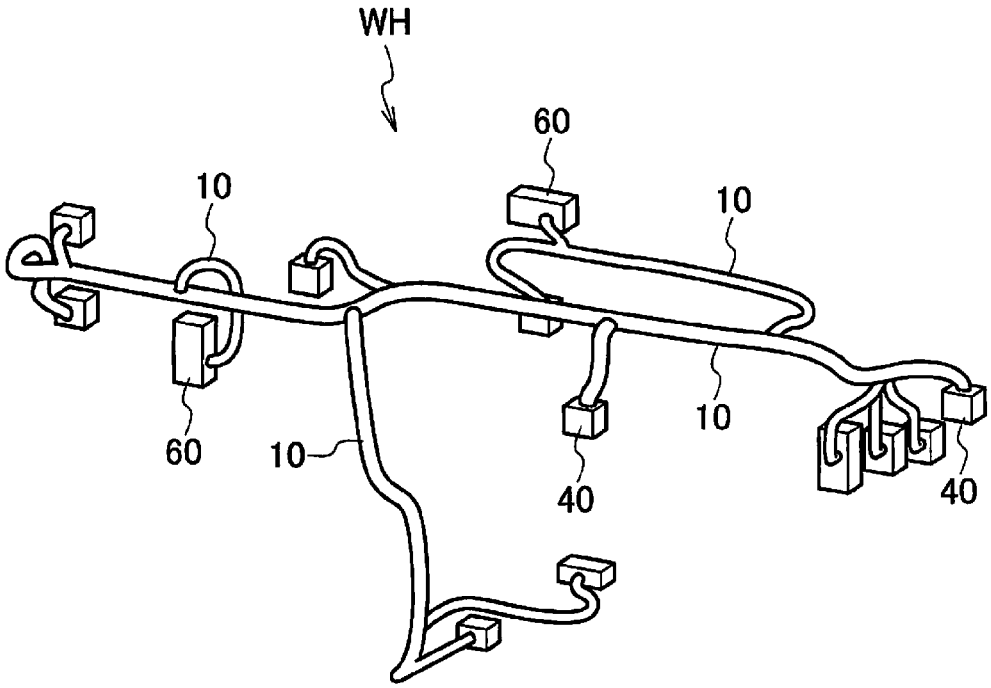
FIG. 9 is a perspective view of a wire harness using a waveguide according to a second embodiment.

FIG. 9 illustrates a second embodiment of the present invention.

As illustrated in FIG. 9, a waveguide wire harness WH used in an in-vehicle communication system includes waveguides 10, and electronic components such as electronic control units (ECUs) 60 and intelligent connectors 40 attached to terminals of the waveguides 10. The waveguides 10 are branched by use of branches (not illustrated).

The configuration of the waveguides 10 according to the second embodiment are the same as that of the first embodiment, and the explanation thereof is thus omitted. In addition, FIG. 9 does not illustrate the two electric wires. The waveguides 10 may be used any of the waveguides 10A to 10D according to the respective modified examples of the first embodiment. Each of the ECUs 60 is a controller that includes similar functions of the intelligent connector 40 in the first embodiment.

Since the waveguide body according to the second embodiment is also flexibly formed, cabling along arbitrary installation paths is possible. Further, the waveguides 10 can transmit both of the electric power and the signals. Accordingly, the second embodiment can provide the waveguides 10 capable of transmitting the electric power, and the in-vehicle communication system using the waveguides 10 while having high installation performance.

(Other Embodiments)

Although the waveguide body 11 in the respective embodiments has a circular cross-section, the waveguide body 11 may be an arbitrary shape having, for example, a rectangular cross-section as long as it is a hollow tubular body.

In the case where the conductive inner coating layer 12 is provided on the inner surface of the waveguide body 11, and the waveguide body 11 is made from a protective material, the waveguide body 11 may also function as an outer protective member (such as a protector or a corrugated member) in a manner such that the thickness of the waveguide body 11 is increased. Such a configuration can eliminate any additional outer protective member from the waveguide wire harness WH.

What is claimed is:

1. A waveguide for an in-vehicle communication system, comprising:

a waveguide body which has a hollow interior and made from a shape-retentive material;

one or two conductive coating layers which are electrically conductive and provided by plating on one or both of an inner surface and an outer surface of the waveguide body, for transmitting electromagnetic waves including signals; and a power line for transmitting electric power other than the signals, the power line comprising an electric wire provided in parallel to the waveguide body, wherein the electric wire is provided along the outer surface of the waveguide body, and serves as a ground line.

2. The waveguide according to claim 1, wherein the shape-retentive material of the waveguide body corresponds to a flexible material.

3. The waveguide according to claim 1, further comprising a cap attached to an opening edge of the waveguide body and provided, with an electromagnetic wave absorbing material capable of absorbing the electromagnetic waves.

4. The waveguide according to claim 1, wherein the shape-retentive material comprises synthetic resin, paper or metal.

5. A waveguide for an in-vehicle communication system, comprising:

a waveguide body which is hollow inside and made from a shape-retentive material;

first and second conductive coating layers which are electrically conductive and provided by plating on an inner surface and an outer surface of the waveguide body, wherein the first conductive coating layer is used for transmitting electromagnetic waves including signals; and a power line for transmitting electric power other than the signals, the power line comprising the first conductive coating layer, wherein the second conductive coating layer serves as a ground line.

6. A waveguide for an in-vehicle communication system, comprising:

a waveguide body which has a hollow interior and made from a shape-retentive material;

one or two conductive coating layers which are electrically conductive and provided by plating on one or both of an inner surface and an outer surface of the waveguide body, for transmitting electromagnetic waves including signals; and a power line for transmitting electric power other than the signals, the power line comprising a first electric wire provided in parallel to the waveguide body, ;and a second electric wire provided along the outer surface of the waveguide body, wherein the second electric wire serves as a ground line.

7. A waveguide for an in-vehicle communication system, comprising:

a waveguide body which has a hollow interior and made from a shape-retentive material;

one or two conductive coating layers which are electrically conductive and provided by plating on one or both of an inner surface and an outer surface of the waveguide body, for transmitting electromagnetic waves including signals;

a power line for transmitting electric power other than the signals, the power line comprising a first electric wire provided inside the waveguide body; and a second electric wire provided inside of the waveguide body, wherein the second electric wire serves a ground line.

* * * * *